US005520517A

United States Patent [19]

Sipin

[11] Patent Number: 5,520,517

[45] Date of Patent: May 28, 1996

[54] MOTOR CONTROL SYSTEM FOR A CONSTANT FLOW VACUUM PUMP

[76] Inventor: Anatole J. Sipin, 221 E. 78th St., New York, N.Y. 10021

[21] Appl. No.: 69,531

[22] Filed: Jun. 1, 1993

[51] Int. Cl.[6] ..... F04B 49/06

[52] U.S. Cl. ..... 417/44.3; 417/44.11

[58] Field of Search ..... 417/43, 44.1, 44.2, 417/44.3, 45

[56] References Cited

U.S. PATENT DOCUMENTS

| | | | |
|---|---|---|---|
| 4,384,825 | 5/1983 | Thomas et al. | 417/22 |
| 4,527,953 | 7/1985 | Baker et al. | 417/43 |
| 5,269,659 | 12/1993 | Hampton et al. | 417/43 |
| 5,295,790 | 3/1994 | Bossart et al. | 417/43 |

FOREIGN PATENT DOCUMENTS

| | | | |
|---|---|---|---|
| 2021821 | 12/1979 | United Kingdom | 417/43 |

*Primary Examiner*—Richard A. Bertsch
*Assistant Examiner*—Roland G. McAndrews, Jr.
*Attorney, Agent, or Firm*—Hedman, Gibson & Costigan

[57] ABSTRACT

The invention is a constant flow pump control system that compensates for a change in gas flow rate that is caused by a change in the load resistance, by making the speed change inversely with the change in load resistance, desirably by sensing the change in pressure and changing speed by an amount related to the pump performance characteristic that is required to restore the flow rate to its selected value. In a preferred embodiment the system includes a closed loop pump speed control in which a selected flow rate reference is combined with a pressure feedback to provide an inverse change in the pump speed reference function or a direct change in the motor speed feedback function to compensate for the change in flow rate caused by a change in flow resistance.

19 Claims, 10 Drawing Sheets

MOTOR CONTROL SYSTEM FOR A CONSTANT FLOW VACUUM PUMP

BACKGROUND OF THE INVENTION

This invention relates to the control of gas flow from a pump through a resistive load at a constant selected flow rate without unacceptable effect of change in load resistance. A major application is in the sampling of environmental air for the purpose of measuring levels of airborne contaminants for protection against pollutant-related diseases. For a number of years personal and area sampler pumps have been used to draw air samples of known volumes through collection devices, such as filters, to collect particulates in the sampled air volume, and sorbent tubes to trap vapors and Gases for future analysis, as well as direct reading colorimetric indicator tubes. Pumps have also been used for direct collection of air samples for analysis. Although fixed volume grab samples are sometimes taken, these are usually for reasons of immediate safety, and for long-term health protection, the air sampled should be taken at a constant rate over an extended period of time to provide a time-weighted average measure of the contaminant concentration. Personal sampler pumps are designed to be worn by the individual being monitored for a number of hours so as to obtain a measure of the average concentration of contaminant breathed by an ambulatory worker or other individual at various locations.

The health hazard caused by airborne asbestos fibers is widely recognized, and various governmental regulations on the federal, state and local levels have been promulgated for the removal of asbestos from existing structures and vehicles. An application of the subject invention is for personal monitoring at sites of asbestos removal. The application is not limited to asbestos monitoring, however, as there are continuing hazards from other airborne dusts such as silica, cotton dust, and, more recently, airborne lead, which provide requirements for an improved air sampler.

There are certain limitaions of sampler pumps currently available. In most portable pumps the flow rate is set at the beginning of the sampling period by connecting the pump to an external meter at the beginning of the sampling period, and an inferential control is used to maintain constant flow during sampling. Also, where a flow indicator is supplied with the pump, it is usually of poor accuracy, such as a small rotameter, and it is located on the outlet of the pump where an erroneous indication can occur due to leakage in the pump and pneumatic line.

Baker and Clark in U.S. Pat. No. 4,063,824 show a control in which the pressure drop across a constant orifice (or valve) is maintained at a constant value by means of a pressure switch and integrator, which vary the pump speed. To change the flow rate, however, an external flowmeter must be connected, and the valve setting changed, a procedure which is difficult to accomplish satisfactorily in the field.

Lalin in U.S. Pat. No. 4,432,248, and Hollenbeck in U.S. Pat. No. 4,237,451 describe control systems in which the flow rate is manually set prior to sampling, and the flow rate is controlled by adjusting pump speed in relation to increase in motor current caused by loading of a (particulate) collection filter.

In U.S. Pat. No. 5,000,032 I have disclosed a controlled sampler in which the direct measurement of the true volumetric flow rate is used to set and control the flow rate of sampled air. It is not necessary to set the flow rate with an external calibrator or flowmeter prior to sampling. The sampler includes an accurate linear flowmeter so that flow rate can be precisely changed in the field and during sampling. This device has been used for area sampling and provides excellent performance. A drawback with this controlled sampler for application as a personal sampler is that the size and weight of the flowmeter are excessive. Also, a laminar flowmeter is used with a differential pressure transducer, whose range is limited for accurate readings to approximately 10:1; and the pressure drop required for accurate measurements with current semiconductor transducers will require larger batteries and additional weight for a personal sampler.

Betsill et al in U.S. Pat. No. 5,163,818 disclose a constant air flow rate pump for sampling air in which air flow rate is computed from measurements of voltage, current and motor speed. Computation of flow rate from pump characteristics is appealing, since it eliminates the size and weight attributed to direct flowmeters, and this means has been used precisely in my U.S. Pat. No. 4,957,107 for gas delivery means and used in a prototype wearable ventilator. It is doubtful, however, that more than short-term accuracy can be achieved from a computed value based on current drain because of the various energy loss mechanisms in addition to flow rate, such as friction, that can change the current.

There is a need for a constant flow rate pumping system that permits the accurate setting of flow rate at any time without need for prior setting with an external flowmeter or calibrator that has a relatively wide operating range, and that achieves this operation with a minimum number of components and minimum size and weight suitable for a personal sampler pump.

SUMMARY OF INVENTION

The invention is a constant flow pump control system that compensates for a change in gas flow rate that is caused by a change in the load resistance, by making the speed change inversely with the change in load resistance, desirably by sensing the change in pressure and changing speed by an amount related to the pump performance characteristic that is required to restore the flow rate to its selected value. In a preferred embodiment the system includes a closed loop pump speed control in which a selected flow rate reference is combined with a pressure feedback to provide an inverse change in the pump speed reference function or a direct change in the motor speed feedback function to compensate for the change in flow rate caused by a change in flow resistance.

The preferred embodiment of the constant flow pump control system includes:

- a DC motor-driven air pump,
- a flow rate reference element with an output that is linearly related to a selected value of flow rate,
- a load sensor, preferably a pressure transducer, with an output related to the pressure drop across a pneumatic load,
- a pump speed reference that accepts the outputs of the flow rate reference element and the load sensor to provide a reference signal for a pump speed that will produce the selected flow rate in accordance with the pump performance characteristic,
- a pump motor drive connected to receive the speed reference signal and a motor speed feedback related to the pump motor speed and to provide a drive voltage to the pump drive motor to provide a pump speed that is linearly related to the speed reference signal and to provide the selected flow rate.

DETAILED DESCRIPTION OF THE INVENTION

Figure 1:
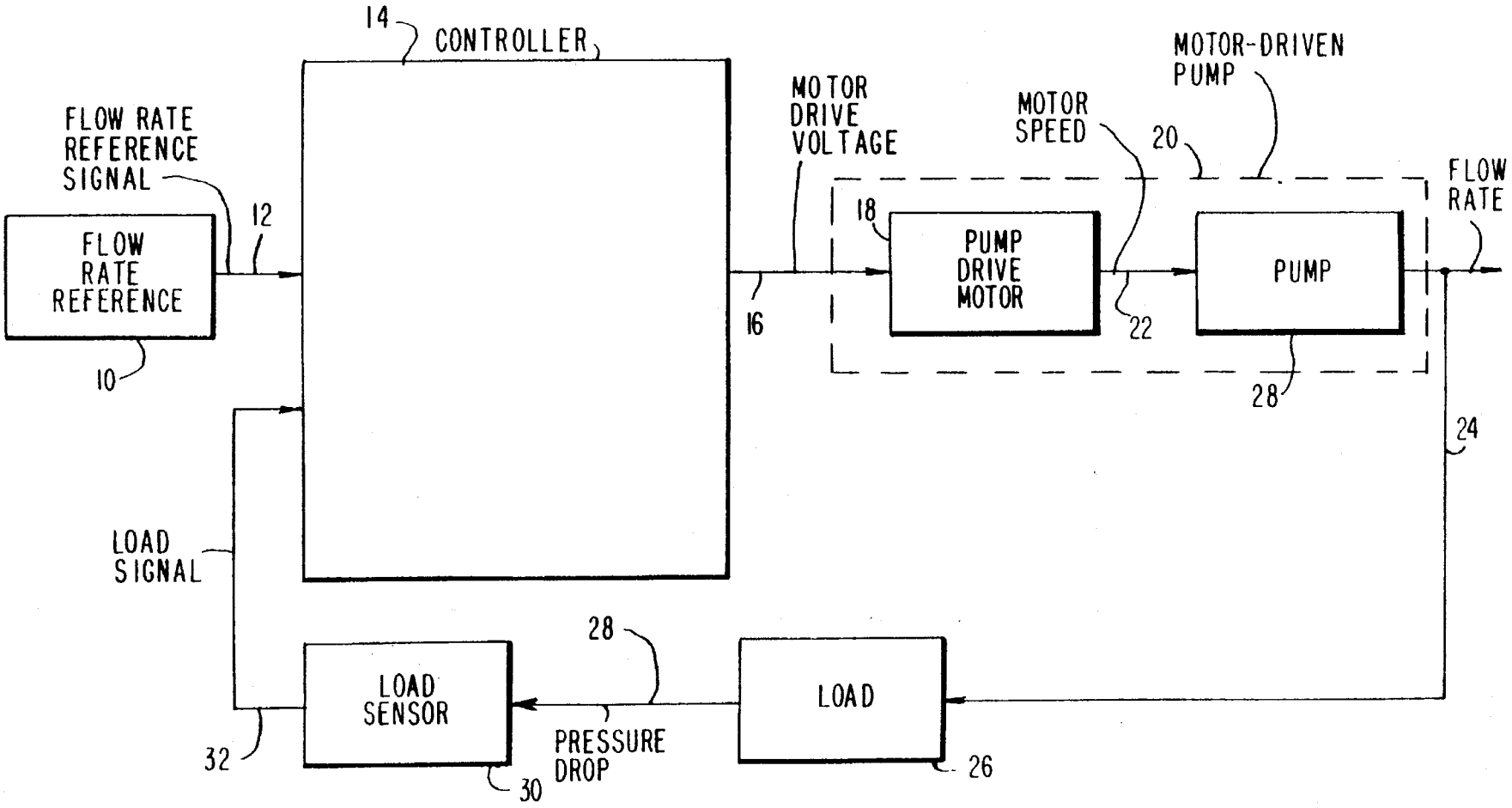
FIG. 1 is a functional block diagram of the constant sampler flow pump control system.

Referring to FIG. 1, it is seen that a gas flow rate reference element 10 has an output on flow rate reference lead 12 which is fed to a controller 14. Controller 14 feeds a drive voltage on lead 16 to the drive motor 18 of a motor-driven gas pump 20, shown functionally in FIG. 1 to produce a related speed of the shaft 22 of motor 18 and pump 23. The pump produces a gas flow rate on line 24 through the resistance of pneumatic load 26, providing a pressure drop, shown functionally by line 28, the effect of which is sensed by a load sensor 30 providing a load signal input to controller 14 on line 32. Controller 14 receives the output of flow rate reference element 10 on lead 12 and the output of the load sensor 30 on line 32, and applies the drive voltage on lead 16 related to these outputs to drive motor 18 so as to provide a speed of pump 23 that will produce the selected value of flow rate in accordance with the characteristic performance of pump 20 among speed, load resistance and flow rate.

Figure 2:
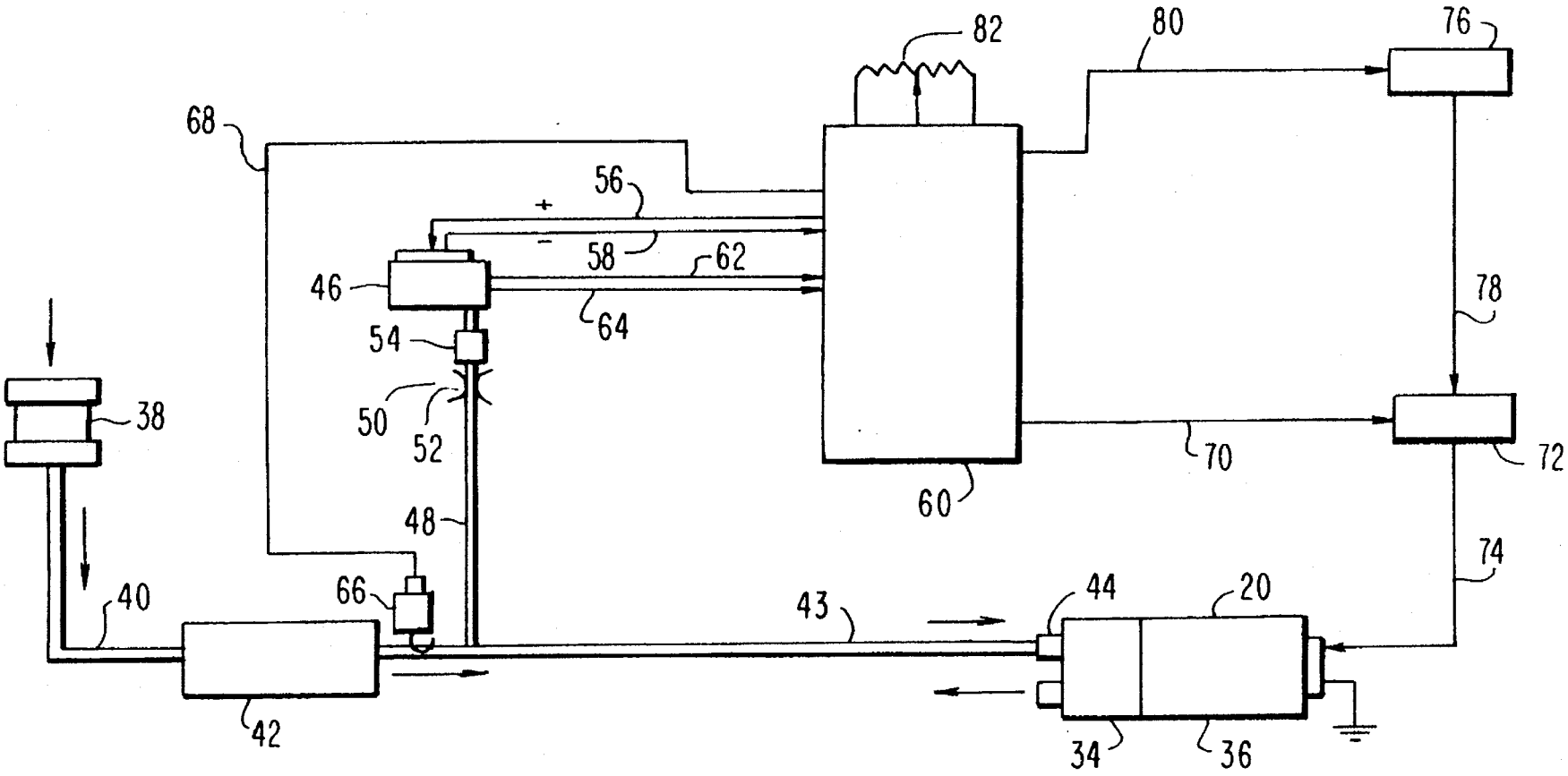
FIG. 2 is a schematic diagram of the system, more clearly showing relationships among the major elements.

FIG. 2 is a schematic diagram that illustrates a preferred mode of operation of the constant flow pump control system. In this mode pump 20 consists of vacuum pump 34 driven by DC motor 36. The vacuum pump draws contaminated air from the atmosphere through a contaminant collection device such as particle collection filter 38. Air is drawn through filter 38, line 40, pulsation damper 42 and line 43 into the inlet 44 of vacuum pump 34. Because of the high pressure drops that can occur across the particle collection filter, vacuum pumps for such applications are usually, but not necessarily, positive displacement types, either vane, piston or diaphragm pumps. All such pumps cause some degree of pulsation in the flow, and it is frequently desirable to minimize such pulsations through use of a pulsation damper. The damper can be an accumulator type with a flexible membrane, or simply an enclosed volume which acts as a pneumatic capacitance. The pressure in line 43, which is substantially that at pump inlet 44, is sensed by gauge pressure transducer 46, which, as shown in FIG. 2, is of the piezoresistive bridge type. Since the gauge pressure between the particle collection filter and the vacuum pump is negative, line 48 feeding pressure to transducer 46 is connected to the low pressure port. It has been found that a pneumatic filter in line 48 to transducer 46 is advantageous. Filter 50 in line 48 consists of restrictor 52 and volume 54. Transducer 46 is excited by positive and negative voltages through lines 56 and 58, from control unit 60 and the output of the piezoresistive bridge of transducer 46 is fed to control unit 60 through lines 62 and 64. An air temperature sensor 66 is shown in the air line 43 to the vacuum pump inlet 44, and the temperature output is fed to control unit 60 through lead 68 to compensate for any effects of temperature on the characteristic performance, if this proves to be significant due to a large range of operating temperature.

A motor drive signal is supplied by control unit 60 through lead 70 to motor power control 72, which supplies current to the motor through line 74. DC power is shown to be supplied from DC battery 76 to power control 72 through line 78 and to control unit 60 through line 80. A flow rate reference can be selected by positioning potentiometer 82.

The controller of FIG. 1 has been deliberately shown as a generalized box to indicate that its function can be performed by various types of input, output and control circuits, both analog and digital, without altering the basic operation of the constant flow pump control system.

Figure 3:
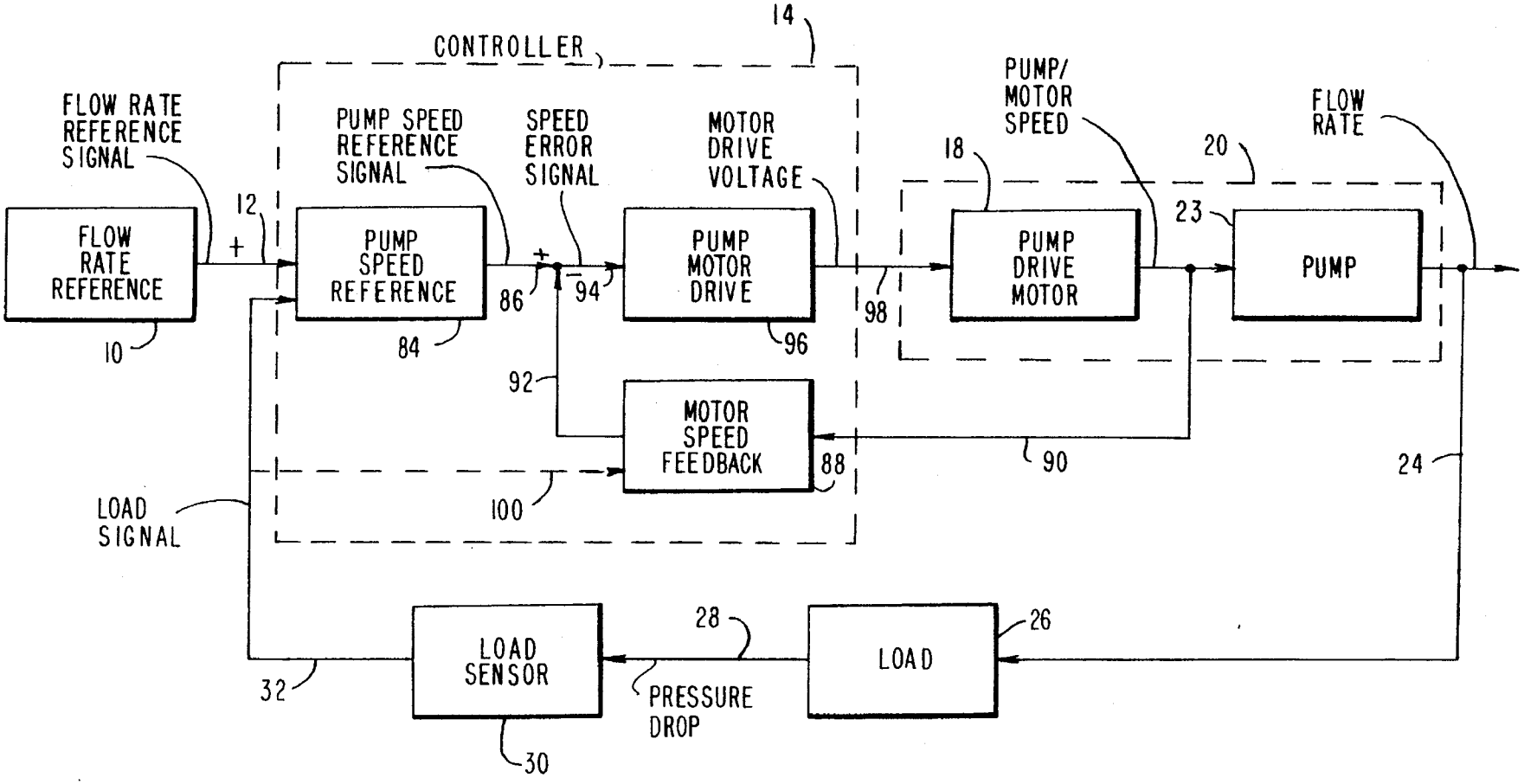
FIG. 3 is a more detailed representation of the block diagram of FIG. 1.

FIG. 3 shows one specific arrangement of elements in the controller 14 that can accomplish the constant flow pump control function of the system, which, stated simply, is to make the pump speed change inversely with the change in gas flow rate that is caused by a change in the load resistance, and by an amount to restore the flow rate to its selected value. In this arrangement the controller 14 contains a closed loop speed control for the pump drive motor 18 which includes:

(a) a pump speed reference element 84 which accepts the output of flow rate reference 10 on line 12 and the output of load sensor 30 on line 32 and provides a pump speed reference signal on line 86, for a pump speed that will produce the selected value of flow rate in accordance with the characteristic performance relation between flow rate, pump speed, and pressure (load) of the pump, (b) a pump motor speed feedback element 88 which accepts pump motor speed, shown functionally as line 90, and provides a pump speed feedback signal on line 92, which is compared with the pump speed reference signal to provide a pump speed error signal on line 94, and (c) a pump motor drive 96 which accepts the speed error signal on line 94 and provides a drive voltage on line 98 that is related to the speed error signal. Motor drive 96 could be of the proportional type, in which case there will be a finite value to the speed error. To provide a small residual error with a purely proportional control usually requires a high value of gain, which can introduce instabilities. A preferred control for the pump motor drive is of the proportional plus integral type as explained in my U.S. Pat. No. 5,000,052 for a Controlled Sampler. In this scheme a proportional error amplifier rapidly provides a speed with an error that is compatible with stable operation, and an error integrator more slowly reduces the error to zero, and maintains the flow rate at its selected value.

The inverse change in pump speed to compensate for a change in flow rate caused by a change in load resistance can also be produced by a direct change in the motor speed feedback function as well as an inverse change in the pump speed reference function. This option is shown in FIG. 3 by provision of the load signal to motor speed feedback element 88 on dashed line 100.

The constant flow rate pump control can be accomplished most effectively by use of a microcomputer, in which the calibrated pump characteristic performance table, relating flow rate, pump speed, and pump pressure is stored in a memory. Selected flow rate is entered into the microcomputer manually as through a keyboard, and the analog motor speed signal and a pump pressure signal are entered through an input A/D converter. An output D/A converter provides a drive signal to the pump drive motor. A primary advantage of such use of a microcomputer with stored pump performance characteristics are that non-linearities in the characteristics and variations in gain are easily accommodated. A similar procedure is used and explained in my U.S. Pat. No. 4,957,107 for Gas Delivery Means for control of a cyclic delivery of gas volume. Major differences are that the pump control herein described continuously controls flow rate at a constant value, and accomplishes this, essentially, by variation of the transfer functions of a pump speed control.

In an uncontrolled system, as, for example, if a constant voltage is applied to the drive motor 36 of vacuum pump 34 in FIG. 2 and if particle collection filter 38 becomes progressively clogged, increasing the pneumatic resistance, the flow rate in line 43 will decrease for two reasons:

(a) decrease in speed at constant voltage due to an increase in power required to maintain the same flow rate against an increased load, and (b) decrease in flow rate at constant speed, also because the motor torque increases, increasing the power requirement. The flow rate can be restored to its original value by increasing the speed by an increment that is determined by the characteristic performance relationship among speed pressure (load resistance) and flow rate, which requires an increase in power input to the pump drive motor.

For a positive displacement pump, as, for example, a diaphragm or piston type with a constant area pumping chamber, a constant stroke and inlet and outlet valves, the flow rate, Q, can be expressed as $Q=K_vN$, where N=pump speed, strokes/min., and $K_v$ is a volumetric stroke coefficient, cc/stroke (for example). The coefficient $K_v$ is largely a function of pump pressure, due to the effect of gas density change in the pumping chamber, but also due to leakage and, possibly, wall distortion (for diaphragm pumps), particularly at low pump speeds. Thus, the coefficient, $K_v$, can also be considered as a function of pump speed as well as pressure, depending on the pump design, condition and speed range.

Defining subscript 1 as identifying an initial condition and subscript 2 as identifying a condition at an increased load resistance, it is seen that:

$$Q_2=(K_{v2}/K_{v1})\ (N_2/N_1)Q_1$$

To maintain flow rate constancy, $Q_2=Q_1$, and $N_2=(K_{v1}/K_{v2})N_1$

Therefore, the speed of the pump should change inversely with the change in the volumetric stroke coefficient, that is with the change in gas flow rate that is caused by a change in resistance of the load.

Figure 4:
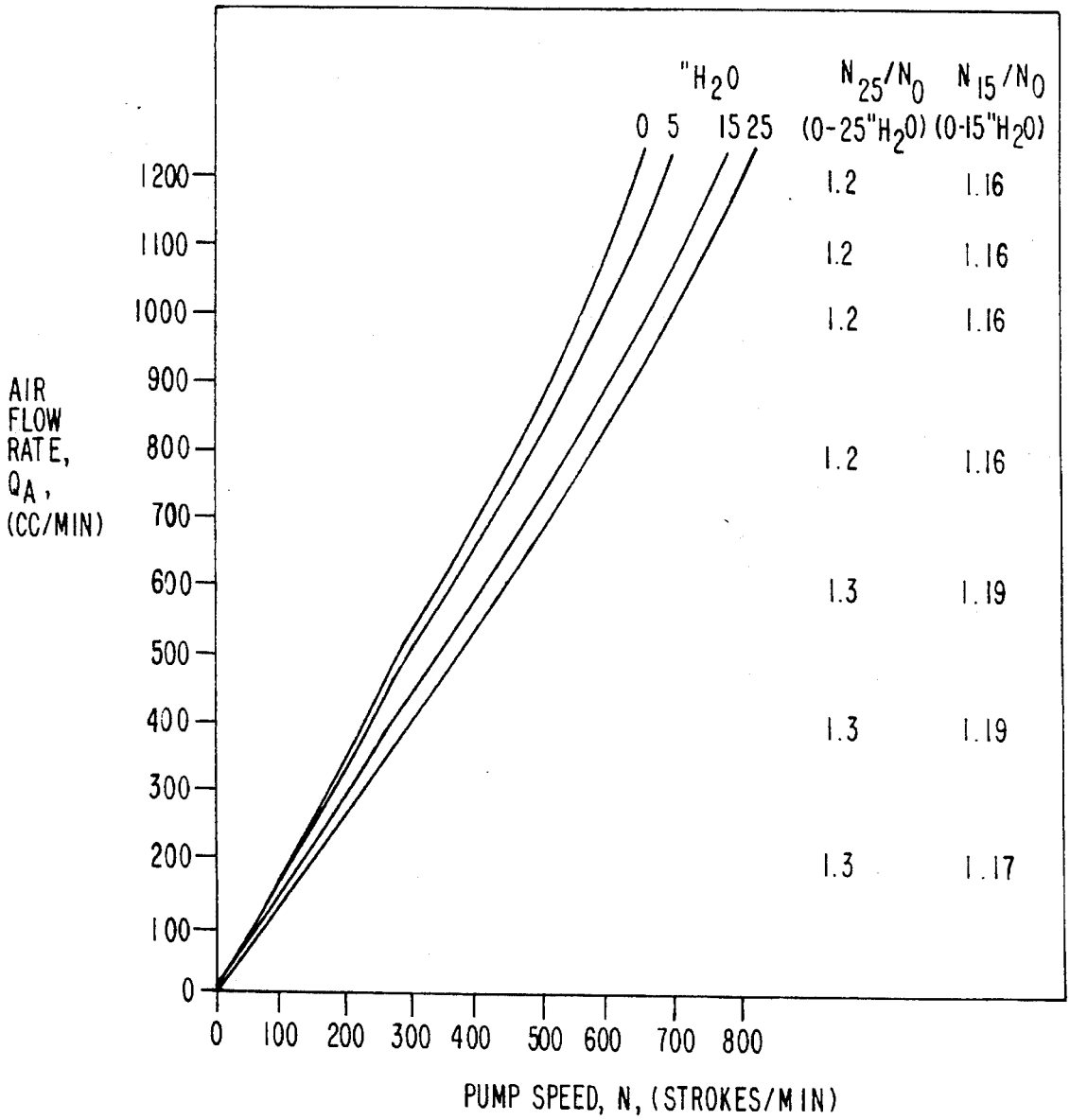
FIG. 4 are characteristic performance curves of a typical positive displacement air pump showing the relationships between flow rate, pump speed, and pressure.

FIG. 4 is a characteristic plot of air flow rate vs. pump speed for a typical Sipin Model SP-103 sampler pump at different values of pump inlet vacuum between 0 in. $H_2O$ and 25 in. $H_2O$. At different values of flow rate for each value of vacuum, it can be seen that the ratio of (increased) pump speed at that vacuum to pump speed at zero vacuum that is required to maintain a constant flow rate is almost constant.

Figure 5:
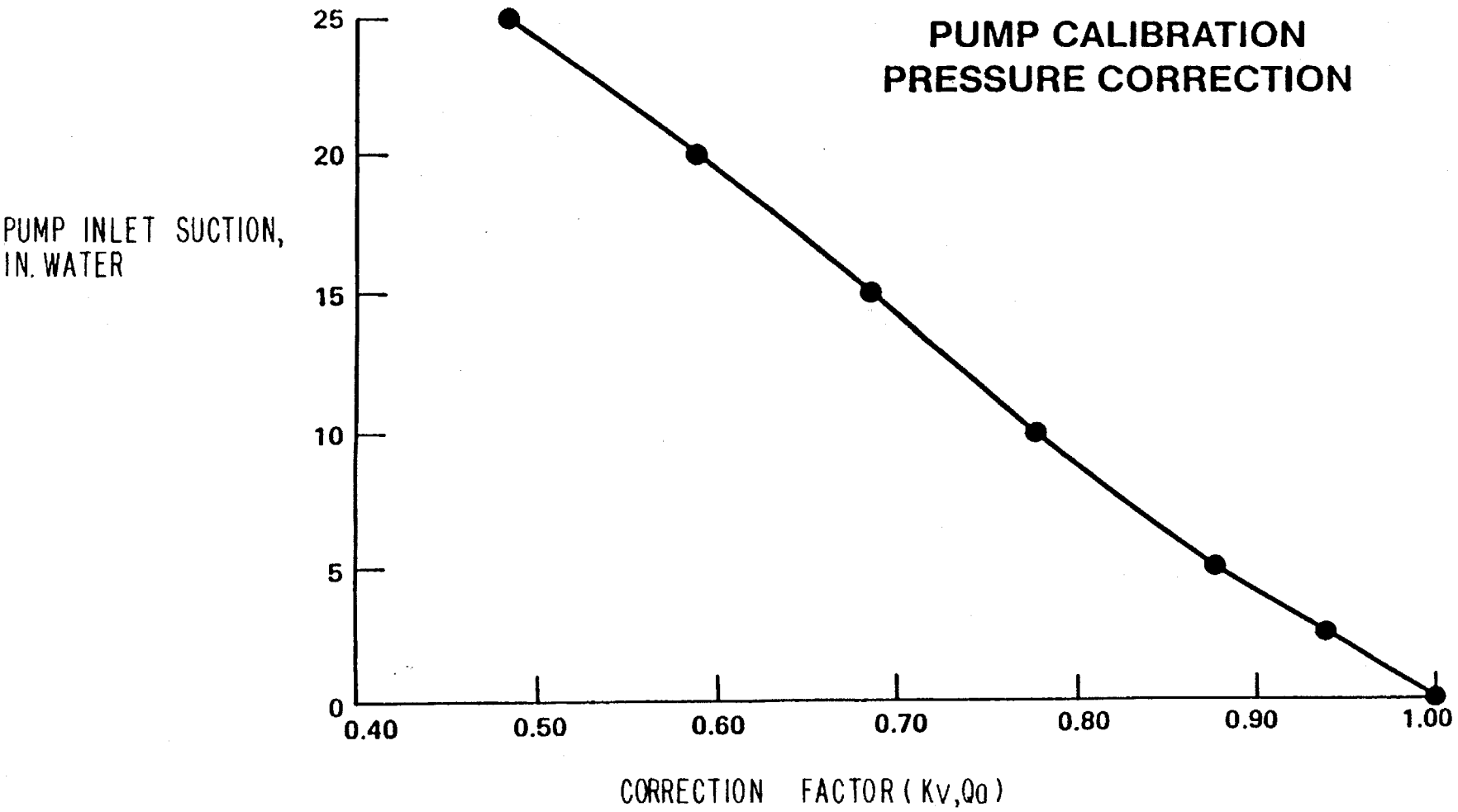
FIG. 5 shows the relation between pump inlet suction and the correction factor to be applied to the nominal stroke volume delivery of another typical positive displacement air pump.

FIG. 5 shows the relation between the volume coefficient, $K_v$ and inlet suction for a typical Sipin Model SP-15 sampler pump having a much lower flow rate and speed range than the Model SP-103, whose characteristic is presented in FIG. 4. It is apparent, however, that the curve of FIG. 5 can be approximated by a straight line, so that $K_v$ can be taken as a linear function of the suction with acceptable error.

The required variation of pump speed to maintain constant flow rate with change in pressure due to change in load resistance can be expressed as:

$$N_2=N_1(1+K_nP)$$

where $K_n$ is a coefficient determined by the calibration of the particular pump.

Use of a closed loop control to maintain pump speed at a selected value is advantageous because it provides stable control of flow rate where the load resistance is low or invariant as is the case with sorbent tube vapor collection devices. The constant flow pump control system disclosed herein takes advantage of the stability of a speed control by modifying gains in the control loop to compensate for changes in the volumetric flow rate/speed relation associated with changes in pressure caused by changes in load resistance.

Figure 6:
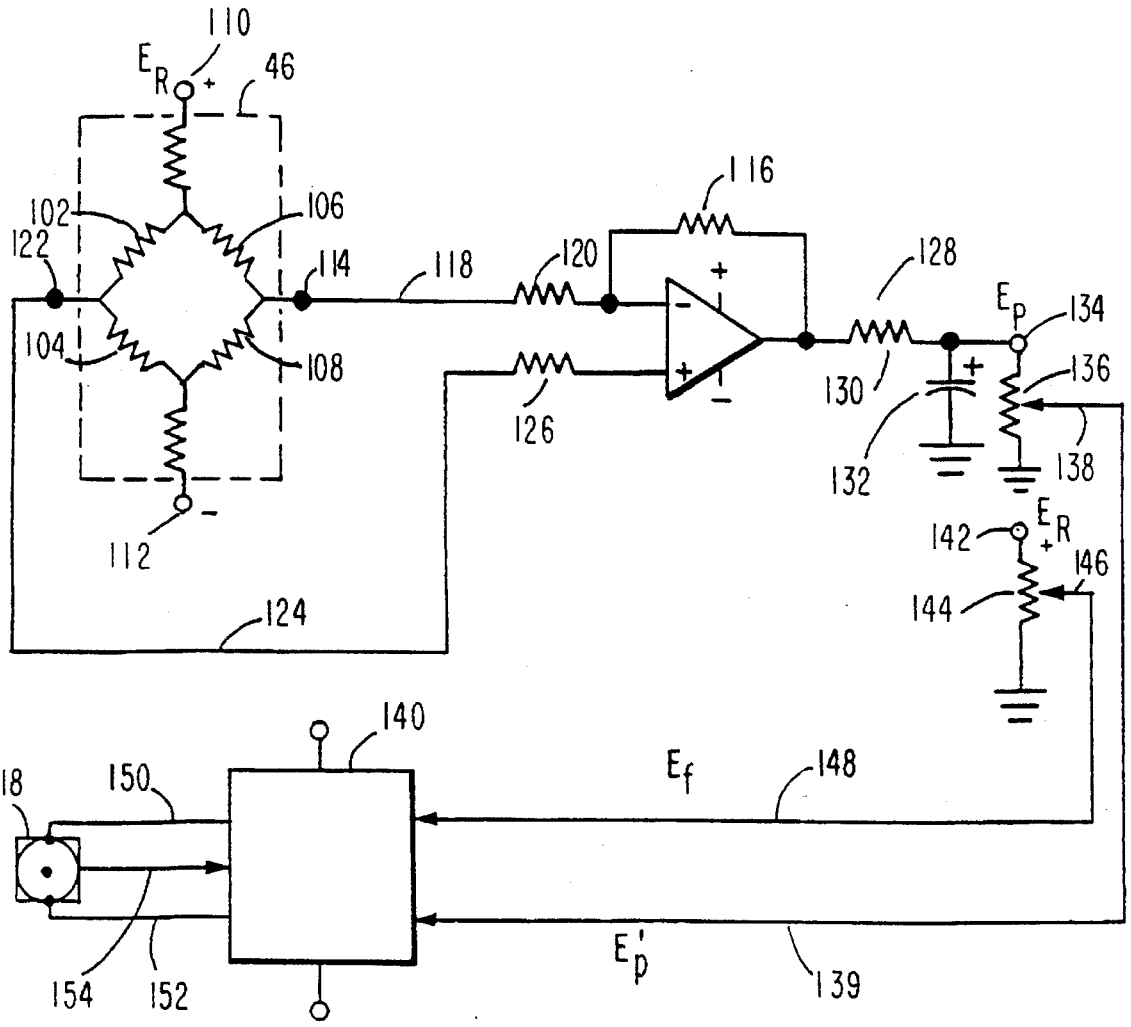
FIG. 6 is a schematic diagram of a general embodiment, illustrating load sensing by a pressure transducer.

A schematic diagram of a general embodiment of the constant flow pump control system that corresponds to the block diagram of FIG. 1 and that illustrates application of a pressure transducer as the load sensor is shown in FIG. 6. The piezoresistive transducer 46 includes active pressure sensitive resistors 102, 104, 106 and 108 connected in a bridge arrangement. A regulated voltage $E_R$ is applied at positive terminal 110 and negative terminal 112. Output terminal 114 is connected to an operational amplifier 116 through lead 118 and input resistor 120. Output terminal 122 is connected to operational amplifier 116 through lead 124 and resistor 126. Low pass filter 128, consisting of resistor 130 and capacitor 132 applies the amplifier output voltage to terminal 134 of pressure signal potentiometer 136. Pump pressure sensed by transducer 46 produces a voltage at terminals 114 and 122 that is fed to operational amplifier 116 that provides a voltage $E_p$, that is proportional to the pressure at terminal 134 of potentiometer 136. Wiper arm 138 of potentiometer 136 applies a voltage $E_p$ that is linearly related to the pressure on lead 139 to control unit 140, which corresponds, generally, to controller 14 of FIG. 1 and control unit 60 of FIG. 2.

Regulated voltage, $E_R$, is also applied to terminal 142 of reference potentiometer 144, whose wiper 146 feeds a flow rate reference voltage $E_f$ also to control unit 140 on lead 148. A motor drive voltage is fed from control unit 140 to pump drive motor 18 on leads 150 and 152, and a speed feedback signal is applied to control unit 140 on line 154.

Control unit 140 can contain a speed control with a reference determined by flow rate reference voltage $E_f$ as modified by pressure related voltage $E_p$. Circuits corresponding to those disclosed in FIG. 3 or a microcomputer can be used to accomplish the control, as previously described.

Figure 7:
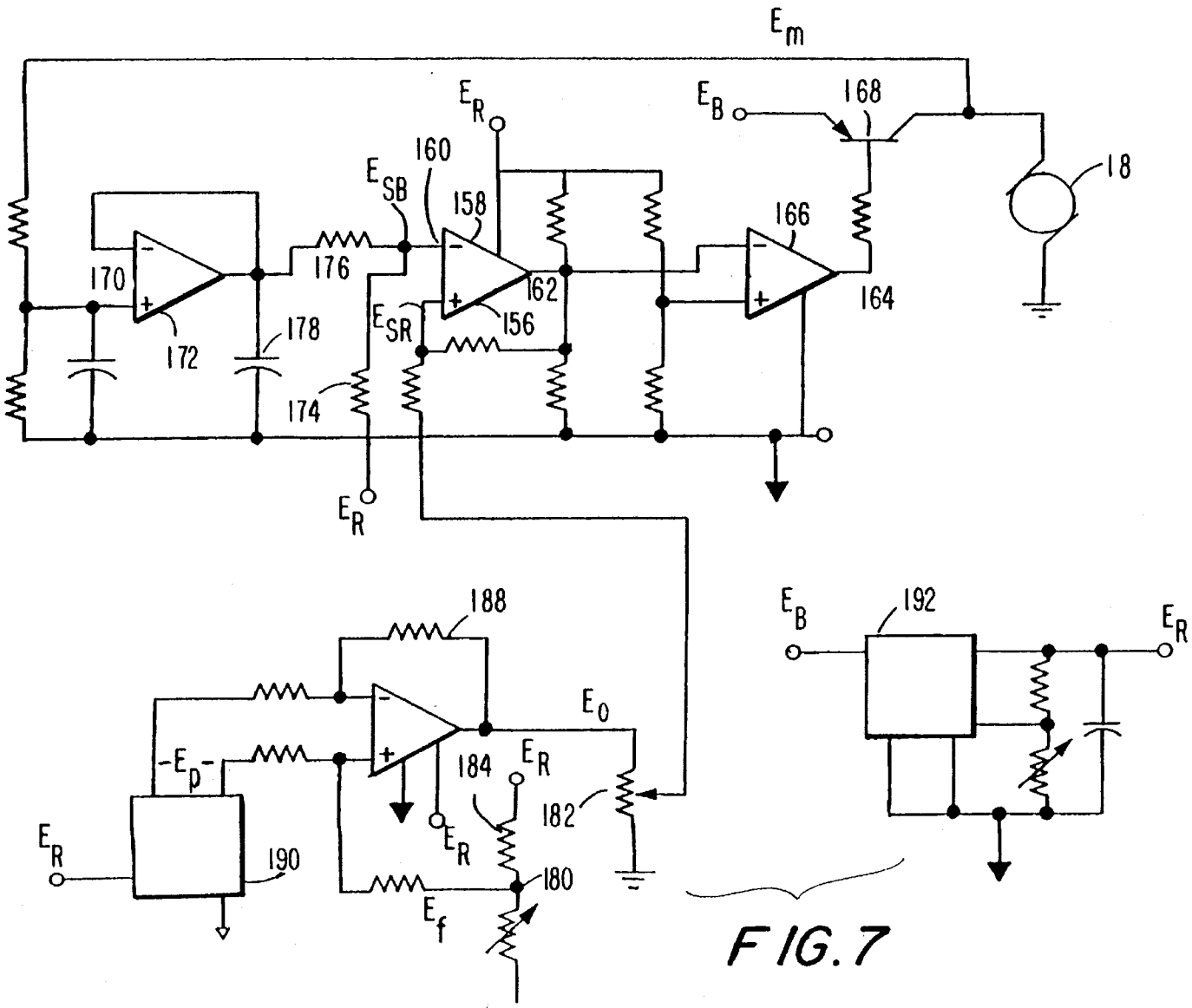
FIG. 7 is an electrical schematic diagram for a preferred embodiment of the constant flow pump control system.

FIG. 7 is an electrical schematic diagram of a preferred embodiment of the constant flow control system. This embodiment includes a closed loop speed control that directly senses back EMF of the drive motor, in which the speed reference signal is increased by a load related component that is provided by a pressure sensing circuit to maintain a constant flow rate, as previously discussed. The closed loop speed control is functionally identical to that disclosed in U.S. Pat. No. 4,292,574 to Sipin et al, entitled "Personal Air Sampler with Electric Motor Driven by Intermittent Full-Power Pulses Under Control, between Pulses, of Motor's Back Electromotive Force". A full explanation of the speed control can be obtained from that patent, and it only will be described to the extent necessary for understanding the embodiment.

Referring to FIG. 7, a speed reference voltage, $E_{SR}$, is applied to the positive input 156 of comparator 158 and a speed feedback voltage, $E_{S8}$ proportional to the back EMF of pump drive motor 18, is applied to the negative input 160 of comparator 158. When $E_{S8}$ is greater than $E_{SR}$, the ouput 162 of comparator 158 is low, the output 164 of comparator 166 is high and drive transistor 168 is cut off. Motor 18 coasts at this condition so that the motor terminal voltage $E_m$ is the back EMF of the motor, which is proportional to motor and pump speed. This voltage is fed back to the positive input 170 of voltage follower 172 to provide the proportional speed feedback voltage $E_{S8}$. When the motor speed decreases so that $E_{S8}$ is less than $E_{SR}$ the voltage at output 164 is low and transistor 168 conducts, applying almost full battery voltage, $E_8$, to motor 18. The duration of this high voltage pulse is determined by an RC circuit composed of resistors 174 and 176 and capacitor 178. Thus, the motor speed is maintained within a narrow band by comparing its back EMF during coasting with a reference voltage.

A selectable flow rate reference voltage $E_f$ is obtained at junction 180 of voltage divider 182 which consists of fixed resistor 184 and variable resistor 186, and which is excited by regulated voltage $E_R$ and it is applied to summing amplifier 188. A voltage proportional to pressure is also applied by pressure transducer 190 to summing amplifier 188 whose output voltage $E_0=C_1E_f+D_2E_p$.

Speed reference voltage $E_{SR}$ has the form $E_{SR}=C_3N=C_4(1+K_n\Delta P)$ and it is evident that the controlled speed, N, is increased by an amount related to the pressure. By proper selection of constants it is seen that the inverse in speed can be made to compensate for the reduction in flow rate caused by an increase in load resistance that is reflected in an increase in pressure.

As shown in FIG. 7, regulated voltage $E_R$ is obtained from battery voltage $E_8$ via a commercially available semi-conductor voltage regulator 192, such as a LM2931 chip.

In FIG. 7 the speed feedback voltage was derived from the directly sensed back EMF of the pump drive motor. A simpler system, in which the feedback voltage is derived from an inferential back EMF, obtained by effectively subtracting a voltage proportional to the armature current of the DC motor from the drive voltage applied to the motor terminals is shown in FIG. 8.

Figure 8:
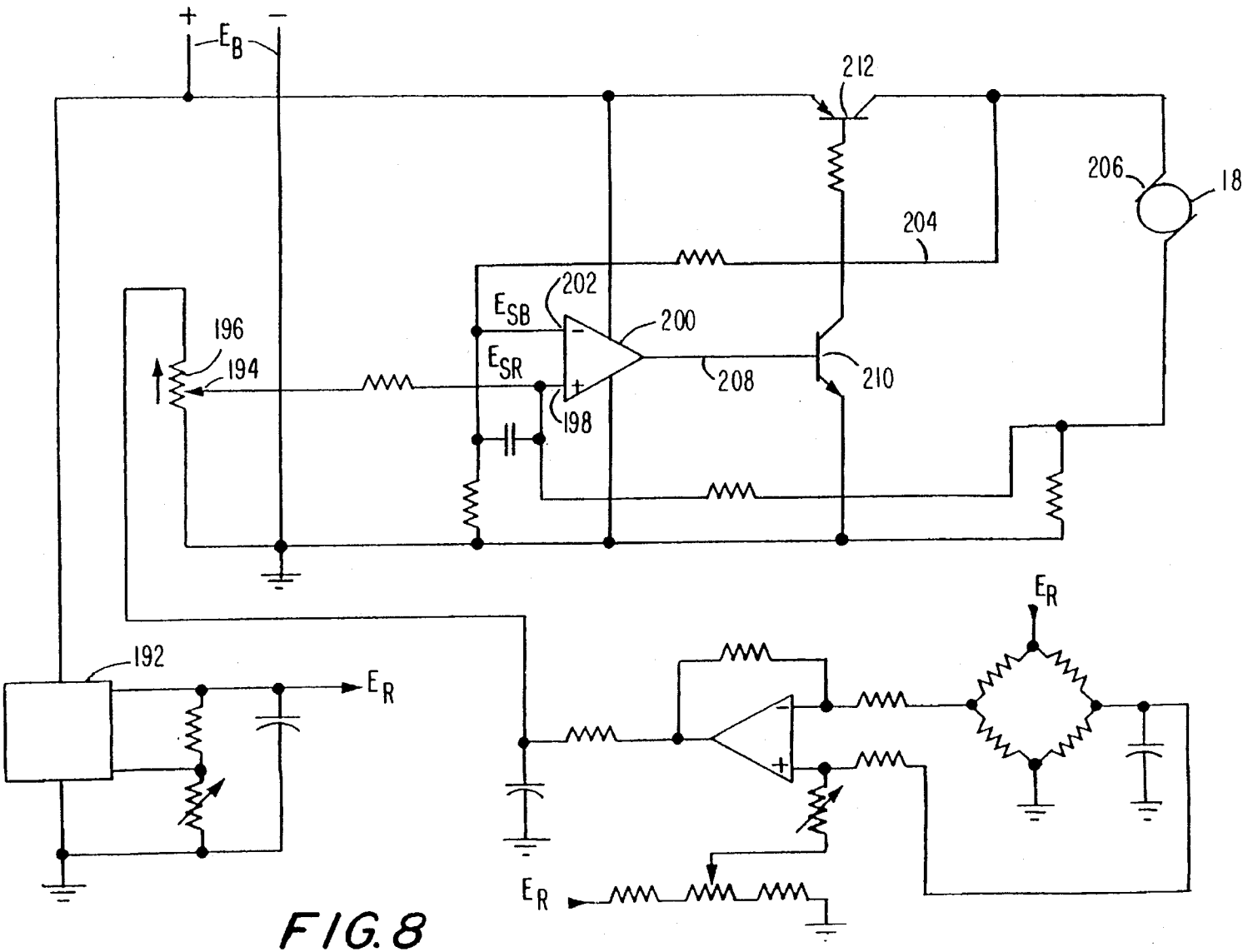
FIG. 8 is an electrical schematic diagram for another embodiment of the constant flow pump control system.

Referring to FIG. 8, a speed reference voltage, $E_{SR}$, is obtained from the wiper 194 of potentiometer 196 and applied to the positive input 198 of differential amplifier 200. A feedback voltage, $E_{S8}$, is fed to the negative input 202 of amplifier 200 through line 204 from the positive terminal 206 of pump drive motor 18. If voltage $E_{S8}$ falls below reference voltage $E_{SR}$ the output 208 of amplifier 200 will become more positive, driving the base of transistor 210 in a positive direction and the base of motor drive transistor 212 in a negative direction, to increase drive current through motor 18 and, therefore, increase feedback voltage $E_{S8}$. The input of transistor 202 is also connected through line 214 across resistor 216, which is connected to the negative terminal of motor 18, and which develops a voltage proportional to the armature current through motor 18. This has the effect of comparing the reference voltage $E_{SR}$ to a voltage proportional to back EMF, but instead of subtracting a current-related voltage from the motor terminal voltage, to infer the back EMF, the same result is obtained by adding a current-related voltage to the reference.

The excitation voltage $E_0$ for speed reference potentiometer 196 is obtained through line 218 from the output 220 of a flow rate reference and pressure compensating circuit 222, which is functionally identical to that included in FIG. 7 and previously explained. Circuit 222 includes flow rate reference potentiometer 224, pressure transducer 226 and summing amplifier 228. As in the system of FIG. 7, pressure compensating circuit 222 provides a speed reference voltage $E_{SR}$ with the form, $E_{SR}=C\ (1+K_nP)$, having the same effect of controlling speed to maintain a constant flow rate.

Voltage regulator 192 in FIG. 8 is the same as the one described for FIG. 7.

It has been shown in FIGS. 4 and 5 that the variations of speeds with pressures required to maintain a constant flow rate are reasonably uniform over a given flow range, and the variation of the volumetric pump coefficient with pressure is also reasonably linear, so that constant coefficients can be used with good results. For Greater accuracy and where a pump must operate over a wide range, a closer matching could be desirable. It also has been stated that variation of pump speed to maintain a constant flow rate can be expressed as $N_2=N_1(1+K_nP)$ and that a corresponding speed reference voltage can be expressed as $E_{SR}=C\ (1+K_nP)$. The coefficients are not always constant and, to varying degrees, they could be functions of pressure and also speed. Since these are related to flow rate, the speed compensation coefficient could be varied with the flow rate reference to provide clear control of the flow rate.

Figure 9:
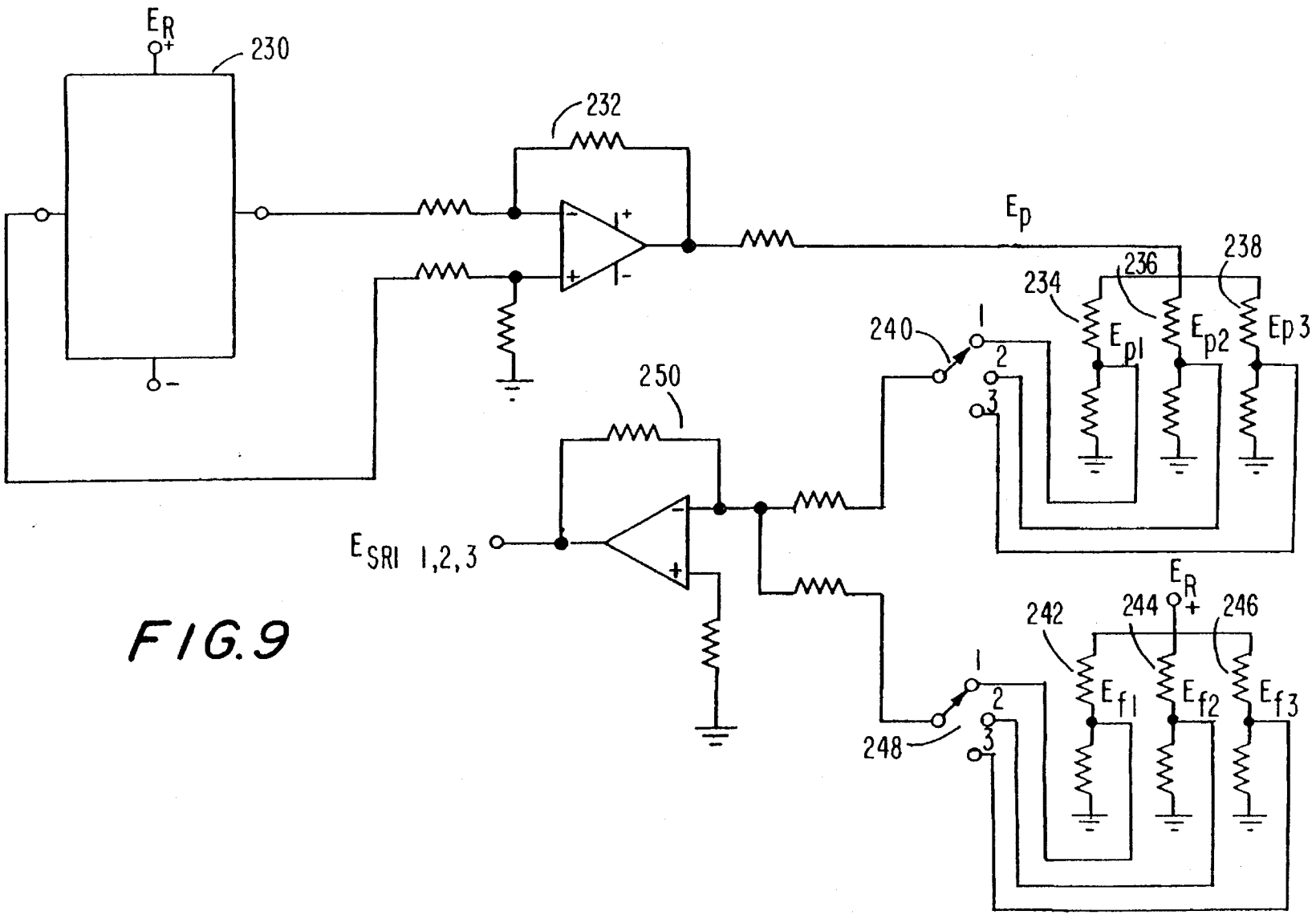
FIG. 9 is an electrical schematic diagram showing means for application of different speed compensation coefficients for different values of selected flow rate.

An arrangement to provide selection of speed compensation coefficients with selection of flow rate reference is shown in FIG. 9. For simplicity selection of flow rate references is shown to be accomplished by switching among fixed values rather than continuous adjustment of a potentiometer or variable resistor. Voltages from a resistive bridge pressure transducer 230 are applied to the inputs of a differential amplifier 232 whose output, $E_p$, is a voltage that is proportional to sensed pressure and is applied to resistive voltage dividers 234, 236 and 238. The voltage dividers have different ratios, such that speed compensation voltages, $E_{p1}$, $E_{p2}$ and $E_{p3}$, which are proportional to pressure-related voltage $E_p$ are applied to terminals 1, 2 and 3 of selector switch 240. Similarly, flow reference voltages $E_{f1}$, $E_{f2}$ and $E_{f3}$ are derived from voltage dividers 242, 244 and 248 with different ratios, and they are applied to terminals 1, 2 and 3 of selector switch 248. The switch outputs $E_{p1,2,3}$ $E_{f1,2,3}$ are fed to summing inputs of operational amplifier 280, whose output is the speed reference $E_{SR1,2,3}$. $E_{SR1}=C_1\ (1+K_{n1}\Delta P)$; $E_{SR2}=C_2\ (1+K_{n2}\Delta P)$; $E_{SR3}=C_3\ (1+K_{n3}\Delta P)$. The coefficients $C_{1,2,3}$ and $K_{n1,2,3}$ are matched from pump performance characteristics, and they provide accurate compensation to maintain constant values of flow rate with change in pressure for widely varying flow rates.

In air sampling for contaminants it is sometimes desirable to sample for several contaminants simultaneously with different collection devices and at different flow rates, as, for example, use of different sorbent tubes or long-duration colorimetric detector tubes. For such an application manifolds are commercially available for use in drawing air through several tubes in parallel. Normally, suction is controlled at a constant value and a calibrated orifice in each tube line determines the flow rate.

Figure 10:
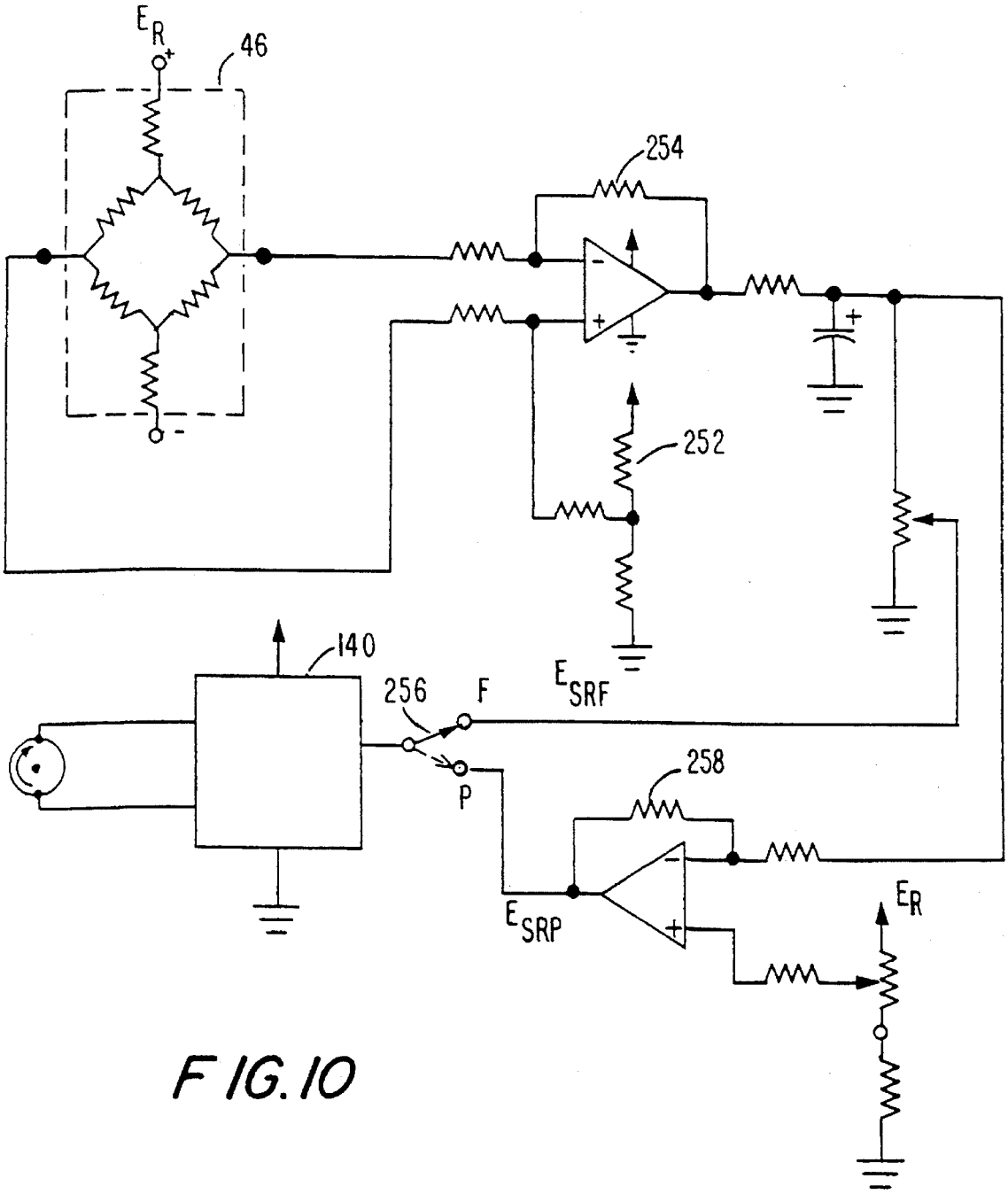
FIG. 10 is an electrical schematic diagram showing how the constant flow pump control system can also be adapted for control of pressure by variation of pump speed.

FIG. 10 shows the expansion of the disclosed constant flow pump control system as illustrated in FIG. 6 to include an optional pressure control. A flow reference voltage $E_{fR}$ is obtained from voltage divider 252 and combined with a pressure related voltage, $E_p$ from transducer 46 in summing amplifier 254 to provide a compensated speed reference voltage $E_{SRF}$ at terminal F of switch 256.

The same voltage is fed to a differential amplifier 258 where it is compared with a pressure reference voltage from voltage divider 260 to provide a speed reference voltage $E_{SRP}$ related to pressure error at terminal P of switch 256. Either the flow-related or pressure-related speed reference voltage is fed to control unit 140, to maintain constant flow rate or constant pressure. An advantage of the system in FIG. 10 is that it provides optional flow rate or pressure control with use of the same transducer and other system components requiring addition of a minimum number of additional elements.

What is claimed is:

1. In a constant flow rate pump control, an electric motor-driven pump, connected in a fluid line, said pump having a calibrated characteristic performance, relating pump flow rate, pump speed, and pump pressure, a pump pressure sensor having an output connected to said line, a microcomputer having an input, an output and a memory in which is stored said calibrated pump characteristic performance, means to enter a selected flow rate into said microcomputer input, means to enter the output of said pump pressure sensor into said microcomputer input, and means to provide a signal from the microcomputer output to drive the motor of said pump at a speed determined by said stored calibrated pump characteristic performance to continuously control flow rate at the selected constant value.

2. A system to control fluid flow produced by a pump through a resistive load at a constant selected flow rate, which consists essentially of:

a fluid load, including a line, providing a resistance to flow that causes a pressure in the line related to the flow rate, an electric motor-driven pump having a port connected to said line, to pump fluid through said load at a flow rate that is related to the speed of said pump and to the pressure in said line at said port, by the fluid performance characteristic of said pump, a flow rate reference element with an output that is linearly related to a selected value of flow rate, a gauge pressure sensor connected to said line with an output related substantially to the pressure at said port in said pump, and a controller that incorporates said pump performance characteristic, and that is responsive to the outputs of said flow rate reference element and said pump pressure sensor in a manner to apply an electrical input to the drive motor of said pump that provides a pump speed that will produce said constant selected flow rate in accordance with the relations of said incorporated pump performance characteristic.

3. A system to control fluid flow produced by a pump through a resistive load at a constant selected flow rate, comprising:

a fluid load, including a line, providing a resistance to flow that causes a pressure in the line related to the flow rate, an electric motor-driven pump, having a port connected to said line, to pump fluid through said load at a flow rate that is related to the speed of said pump and to the pressure in said line at said port, by the fluid performance characteristic of said pump, a flow rate reference element with an output that is linearly related to a selected value of flow rate, a gauge pressure sensor connected to said line with an output related substantially to the pressure at said port in said pump, and a controller, containing a closed loop speed control for the drive motor of said pump, to provide a pump speed that will produce said selected value of flow rate in accordance with the relations of said fluid performance characteristics, said controller including:

(a) a pump speed reference to accept the outputs of said flow rate reference element and said pressure sensor, and to provide a reference signal for a pump speed that will produce said selected value of flow rate, (b) a pump motor speed feedback to sense the speed of said pump drive motor and to provide a feedback signal that is related to said speed, and (c) a pump motor drive, connected to receive said speed reference signal and said speed feedback signal and operatively connected to apply a drive voltage to the drive motor of said pump to provide a pump speed that is linearly related to said speed reference signal.

4. A system to control fluid flow produced by a pump through a resistive load at a constant selected flow rate, comprising:

a fluid load, including a line, providing a resistance to flow that causes a pressure in the line related to the flow rate, an electric motor-driven pump having a port connected to said line, to pump fluid through said load at a flow rate that is related to the speed of said pump and to the pressure in said line at said port, by the fluid performance characteristic of said pump, a flow rate reference element with an output that is linearly related to a selected value of flow rate, a gauge pressure sensor connected to said line with an output related substantially to the pressure at said port in said pump, and a controller that incorporates said pump performance characteristic, and that is responsive to the outputs of said flow rate reference element and said pump pressure sensor in a manner to apply an electrical input to the drive motor of said pump that provides a pump speed that will produce said constant selected flow rate in accordance with the relations of said incorporated pump performance characteristic.

5. A constant flow pump control system as claimed in claim 1, wherein said fluid, is air.

6. A constant flow pump control system as claimed in claim 1, in which said load includes a contaminant collection device.

7. A constant flow pump control system as claimed in claim 1, in which said flow reference element includes a potentiometer excited by an electrical voltage.

8. A constant flow pump control system as claimed in claim 1, in which said pressure sensor is a transducer with a piezo-resistive bridge that is excited by a constant electrical voltage, and said output of said pressure sensor is an electrical signal produced by imbalance of said piezo-resistive bridge that is caused by said pressure at said port.

9. A constant flow pump control system as claimed in claim 1, in which said pump drive motor is of the DC type.

10. A constant flow pump control system as claimed in claim 1, in which said controller includes a microcomputer.

11. A constant flow pump control system as claimed in claim 1, in which said gauge pressure sensor includes a pressure transducer, and in which said controller changes the speed of said pump inversely with the change in said fluid flow rate that is caused by a change in resistance of said load, by an amount related to the change in output of said pressure transducer, to restore said flow rate to its selected value.

12. A constant flow pump control system as claimed in claim 1, in which said pump is of a positive displacement type with a known stroke volume, that provides a corresponding delivery of a known volume of said fluid referred to a standard pressure and temperature condition, and in which said controller changes the speed of said pump as an inverse function of the change in said stroke volume delivery of said fluid that is caused by a change in resistance of said load.

13. A constant flow pump control system as claimed in claim 12, in which said inverse function is related to the change with pressure in said stroke volume delivery of said fluid.

14. A constant flow pump control system as claimed in claim 12, in which said inverse function is related to the change with speed in said stroke volume delivery of said fluid.

15. A constant flow pump control system as claimed in claim 1 in which said controller includes:

(a) a pump speed reference to accept the outputs of said flow rate reference element and said gauge pressure sensor, and to provide a reference signal for a pump speed that will produce said selected value of flow rate in accordance with said characteristic performance relations of said pump, and (b) a pump motor drive connected to receive said speed reference signal and operatively connected to apply a drive voltage to the drive motor of said pump to provide a pump speed that is linearly related to said speed reference signal, so as to provide a flow rate at said selected value.

16. A constant flow pump control system as claimed in claim 15, including:

(a) means to combine the reference output that is related to flow rate with the pressure sensor output to provide a speed reference signal that is related to flow rate, (b) a reference element with an output that is linearly related to a selected value of pump pressure, (c) differential means to compare the outputs of said pressure related reference element and said pressure sensor to provide a speed reference signal that is related to pressure error, and (d) switching means to optionally provide either the flow-related speed reference signal or the pressure-related speed reference signal to said pump motor drive.

17. A constant flow pump control system as claimed in claim 15, in which said controller includes a motor speed feedback to sense the speed of said pump drive motor and to provide a feedback signal that is related to said speed to said pump motor drive.

18. A constant flow pump control system as claimed in claim 17, in which said feedback signal is derived from the directly sensed back EMF of said electric pump motor.

19. A constant flow pump control system as claimed in claim 8, in which said feedback signal is derived from an inferential back EMF, obtained by subtracting a voltage proportional to the armature current of said electric pump motor from the drive voltage applied to the motor terminals.

* * * * *